US005577354A

United States Patent [19]

Van Doren

[11] Patent Number: 5,577,354

[45] Date of Patent: Nov. 26, 1996

[54] EAVE TRIM SYSTEM

[75] Inventor: David A. Van Doren, Hays, Kans.

[73] Assignee: Waffle-Crete International, Inc., Hays, Kans.

[21] Appl. No.: 298,057

[22] Filed: Aug. 30, 1994

[51] Int. Cl.[6] ..... E04C 1/39; E04D 13/15

[52] U.S. Cl. ..... 52/94; 52/97; 52/608

[58] Field of Search ..... 52/91.2, 94, 97, 52/608, 609, 610; D25/113

[56] References Cited

U.S. PATENT DOCUMENTS 4,181,286 1/1980 Van Doren .

4,265,062 5/1981 Klibofske ..... 52/97

FOREIGN PATENT DOCUMENTS 2738996 2/1979 Germany ..... 52/91.2

*Primary Examiner*—Michael Safavi

*Attorney, Agent, or Firm*—Chase & Yakimo

[57] ABSTRACT

A precast concrete roof trim system comprising linear edge segments installed in the side edges of a roof and corner segments installed on the corners of the roof. The corner segments each have free ends engaging the corresponding ends of a spaced pair of the edge segments. Each edge and corner segment has a roof engaging portion with a first surface and a second surface. The first surface engages the roof when the segment is in a first position, and the second surface, which is transverse to the first surface, engages the roof when the segment is in a second position. Each segment has an extension which overhangs the roof when the segment is in the first position and extends upwardly from the roof when the segment is in the second position.

7 Claims, 3 Drawing Sheets

EAVE TRIM SYSTEM

FIELD OF THE INVENTION

This invention relates to a precast roof trim system and in particular, to such a roof trim system which has two installation positions, helps control roof drainage, provides screens for roof mounted equipment and provides railings on roofs used as outdoor patios.

BACKGROUND OF THE INVENTION

Precast concrete buildings commonly have roofs with a flat, smooth outer surface. Such buildings may be advantageously constructed of waffle-shaped panels as disclosed in U.S. Pat. No. 4,181,286 and application Ser. No. 08/247,060 which are hereby incorporated herein by reference. The roofs of such buildings present several problems and disadvantages.

For instance, controlling roof drainage is difficult. Roof-mounted equipment such as air conditioner condenser units and clotheslines are in clear view and cannot be hidden. The roofs become safety hazards for those who desire to use the convenient flat surface as an outdoor patio or otherwise. Additionally, such roofs with no trim are not aesthetically pleasing. Thus, a need exists in the construction industry for a precast concrete roof trim system to be used with precast structural panels.

SUMMARY OF THE INVENTION

Accordingly, a primary object of the invention is to provide a precast roof trim system including a plurality of linear edge segments installed on the side edges of the roof and specially configured to have a first and second installation position.

Another primary object of the invention is to provide a precast roof trim system further comprising a plurality of corner segments, each of which spans the free ends of a spaced pair of edge segments at the roof corners and is specially configured to have a first and second installation position.

It is also an important object to provide such a system in which the first or second installation position may be selected in accordance with the trim effect desired, i.e., an overhang or an upwardly projecting roof extension.

Another object of the invention is to provide a roof trim system which controls roof drainage.

Another object of the invention is to provide a roof trim system which screens roof mounted equipment.

A further object of the invention is to provide a roof trim system that increases the safety of roofs by providing a railing therefor.

A further object of the invention is to provide a roof trim system which is inexpensive to manufacture and easy to install.

Still a further object of the invention is to provide a roof trim system which offers a variety of surface texture options as well as a variety of roof styles.

The foregoing objects are basically attained by providing a precast concrete roof trim system, comprising a plurality of linear edge segments installed on the side edges of a roof and a plurality of corner segments installed on the corners of the roof. Each of the corner segments has free ends which engage corresponding ends of a spaced pair of the edge segments. Both the linear edge segments and the corner segments have a first and second installation positions and include a roof engaging portion and an extension integral with the roof engaging portion. The roof engaging portion of each segment has a first surface and a second surface. The first surface engages the roof when the segment is in its first position, and the second surface, which is transverse to the first surface, engages the roof when the segment is in its second position. The extension overhangs the roof when its associated segment is in the first position, and it extends upwardly from the roof when its associated segment is in the second position.

Other objects, advantages and salient features of the invention will become apparent from the following detailed description, which, taken in connection with the annexed drawings, discloses the preferred embodiment of the invention.

DETAILED DESCRIPTION

Figure 1:
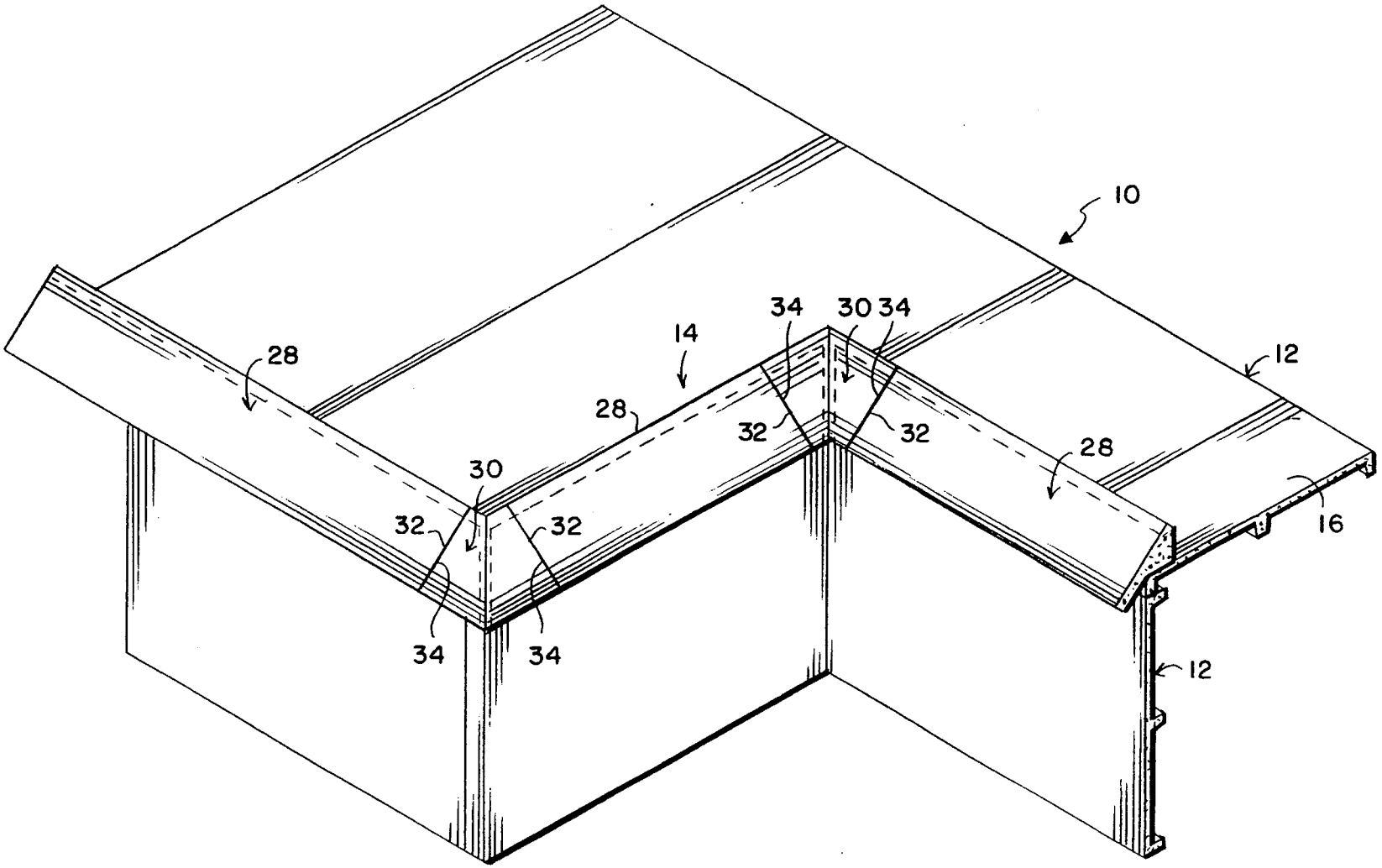
FIG. 1 is a partial perspective view of a building constructed with the roof trim system in accordance with the present invention.
Figure 2:
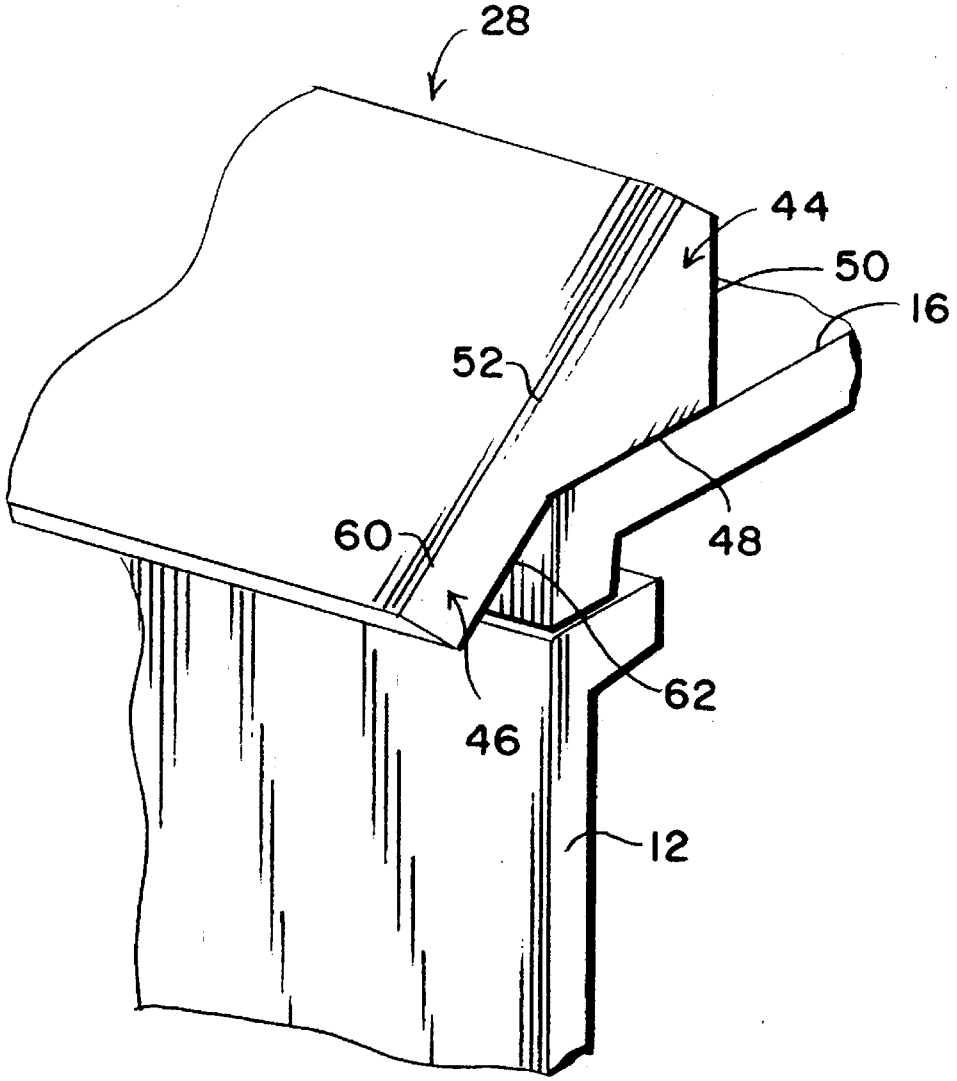
FIG. 2 is a fragmentary, perspective view of a linear edge segment of the roof trim system of FIG. 1.

Referring now to the figures, and in particular to FIG. 1, building 10 is constructed of precast structural panels 12 and precast roof trim system 14. In accordance with the present invention, roof trim system 14 is installed on panels 12 where they form a substantially flat and smooth roof 16.

Roof trim system 14 includes linear edge segments 28 and corner segments 30. Linear edge segments 28 are installed along the side edges of roof 16, and corner segments 30 are installed at the corners of roof 16 and extend a short distance along its side edges as seen in FIG. 1. Corner segments 30 have free ends 32 which engage and abut free ends 34 of a spaced pair of edge segments 28. Likewise, free ends 34 of edge segments 28 also engage free ends 32 of a spaced pair of corner segments 30.

Figure 3:
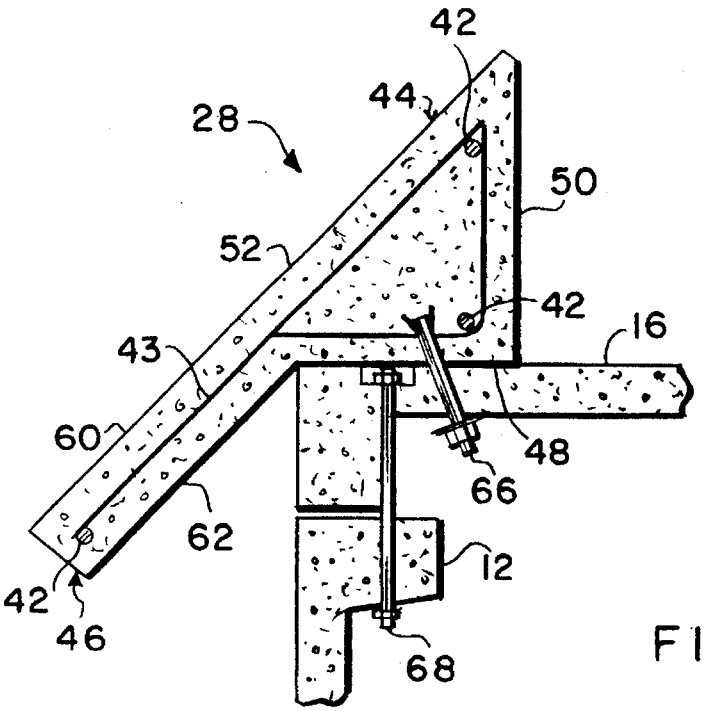
FIG. 3 is a transverse cross-section through an edge segment of the roof trim system of FIG. 1, with the segment in its first position.
Figure 4:
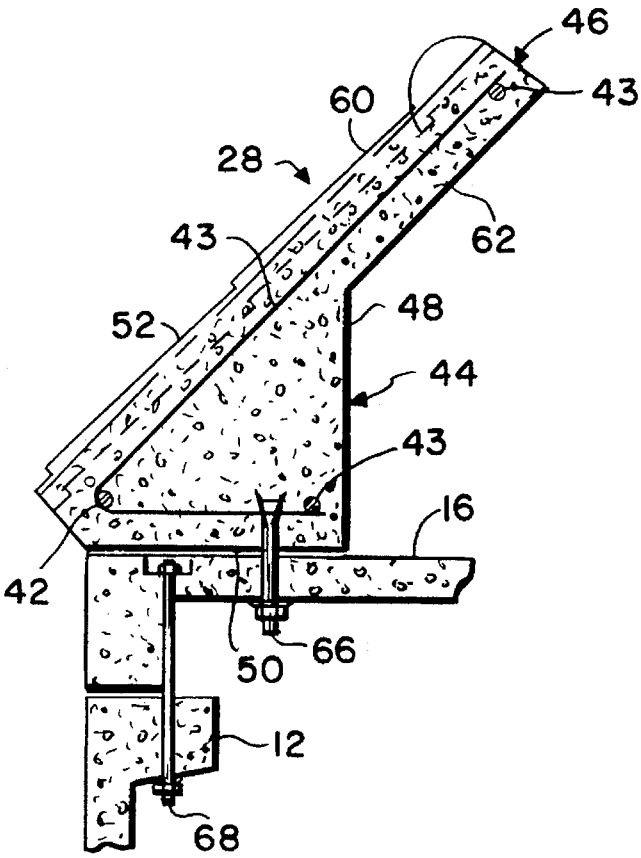
FIG. 4 is a transverse cross-section through an edge segment of the roof trim system of FIG. 1, with the segment in its second position.

Segments 28 and 30 can be installed in either a first position, as seen in FIG. 3, or a second position, as seen in FIG. 4. When segments 28 and 30 are in the FIG. 3 position, they form a mansard style overhang roof, and when in the FIG. 4 position, they form a stand-up style parapet roof. In either position, at least a portion of segments 28 and 30 extends upwardly from roof 16 forming a railing around the roof's perimeter. Furthermore, segments 28 and 30 thereby screen roof mounted equipment.

Segments 28 and 30 include a triangular roof engaging portion 44 and an extension 46. Portion 44 and extension 46 are integrally and unitarily molded from reinforced concrete to form segments 28 and 30. Reinforcing bar 42 and wire mesh 43, as shown in FIGS. 3 and 4, extend through segments 28 and 30 to provide additional strength thereto. Roof engaging portion 44 has a first surface 48 and a second surface 50. Second surface 50 extends transversely of first surface 48, so that surfaces 48 and 50 meet at an inner corner to form a substantially 90 degree angle. First surface 48 engages the exterior surface of roof 16 when segment 28 or 30 is in the FIG. 3 position. Second surface 50 engages the exterior surface of roof 16 when segment 28 or 30 is in the FIG. 4 position. In either the FIG. 3 or FIG. 4 position, the vertical surface 50 or 48 prevents water from flowing in an uncontrolled manner over the edge of the roof 16. This permits the use of downspouts or outspouts (not shown) to drain water from the roof 16 as desired.

Roof engaging portion 44 also preferably includes a third surface 52 which completes the triangular configuration and extends angularly between the outer ends of first and second surfaces 48 and 50.

Extension 46 angularly overhangs the side edge of roof 16 when its associated segment 28 or 30 is in the FIG. 3 position. Extension 46 extends angularly upwardly from roof 16 when its associated segment 28 or 30 is in the FIG. 4 position. Extension 46 has a rectangular cross section and includes outer surface 60 and inner surface 62. In either position, outer surface 60 faces away from building 10, and inner surface 62 faces toward building 10. Extension 46 is also coplanar with third surface 52 such that outer surface 60 of extension 46 forms a continuous extension of third surface 52. A variety of surface texture options can be added to third surface 52 of segments 28 and 30 and outer surface 60 of extension 46, such as Spanish clay tile, as shown in FIG. 3, or wood shake shingle. These textures make roof trim system 14 more aesthetically pleasing.

Anchor members or fasteners 66 are preferably comprised of bolts, as seen in FIGS. 3 and 4. Fasteners 66 are inserted through roof 16 and into roof engaging portion 44. If a bolt such as 68 fastening roof 16 and a side panel 12 together must be avoided, fastener 66 can be inserted into roof engaging portion 44 at an angle, as seen in FIG. 3. Otherwise, fastener 66 is inserted perpendicularly through roof 16 into roof engaging portion 44, as seen in FIG. 4. Fasteners 66 thereby rigidly secure segments 28 and 30 to roof 16.

Only the preferred embodiment of the present invention has been chosen to illustrate the invention, however, it will be understood by those skilled in the art that various changes and modifications can be made herein without departing from the scope of the invention as defined in the appended claims.

Having thus described the invention, what is claimed as new and desired to be secured by Letters Patent is as follows:

1. A precast roof trim system, comprising:

a plurality of linear edge segments adapted to be installed on the side edges of a roof; and a plurality of L-shaped corner segments, each said corner segment adapted to be installed on a corner of the roof between a spaced pair of said edge segments, each said corner segment having a first and second free end engaging a free end of one of said spaced pair of edge segments, said segments having a first installation position and a second installation position, and each including a roof-engaging portion and an extension integrally joined to said roof-engaging portion, said roof-engaging portion of each segment having a first surface and a second surface, said first surface engageable with the roof when said segment is in said first position, said second surface being transverse to said first surface and engageable with the roof when said segment is in said second position, said extension overhanging the roof when its associated segment is in said first position and extending upwardly from the roof when its associated segment is in said second position.

2. A precast roof trim system as claimed in claim 1, wherein said first and second surfaces meet at a corner and form a substantially 90° angle.

3. A precast roof trim system as claimed in claim 1, wherein said roof engaging portion has a substantially triangular cross-section.

4. A precast roof trim system as claimed in claim 2, wherein said roof engaging portion includes a third surface extending between the free ends of said first and second surfaces.

5. A precast roof trim system as claimed in claim 4, wherein said third surface and said extension are coplanar.

6. A precast roof trim system as claimed in claim 1, wherein said segments are substantially formed of concrete.

7. A precast roof trim system as claimed in claim 1, further comprising means for anchoring said segments to the roof.

* * * * *